US010758059B2

(12) United States Patent
Wu

(10) Patent No.: US 10,758,059 B2
(45) Date of Patent: Sep. 1, 2020

(54) CUSHION

(71) Applicant: HANGZHOU SHINNWA HOMETEX CO., LTD, Hangzhou, Zhejiang (CN)

(72) Inventor: Jianguo Wu, Zhejiang (CN)

(73) Assignee: HANGZHOU SHINNWA HOMETEX CO., LTD, Hangzhou (CN)

( * ) Notice: Subject to any disclaimer, the term of this patent is extended or adjusted under 35 U.S.C. 154(b) by 308 days.

(21) Appl. No.: 15/696,134

(22) Filed: Sep. 5, 2017

(65) Prior Publication Data

US 2018/0140109 A1 May 24, 2018

(30) Foreign Application Priority Data

Nov. 21, 2016 (CN) ..... 2016 1 1040756

(51) Int. Cl.

| | |
|---|---|
| ***A47C 27/16*** | (2006.01) |
| ***B68G 11/04*** | (2006.01) |
| ***A47C 27/14*** | (2006.01) |
| ***A47G 9/10*** | (2006.01) |
| ***A47C 31/10*** | (2006.01) |
| ***A47G 9/02*** | (2006.01) |
| ***A47G 9/04*** | (2006.01) |
| ***A47C 7/02*** | (2006.01) |
| ***A47C 7/24*** | (2006.01) |
| ***A47C 7/16*** | (2006.01) |

(Continued)

(52) U.S. Cl.

CPC ..... *A47C 27/16* (2013.01); *A47C 27/14* (2013.01); *A47C 31/105* (2013.01); *A47G 9/0253* (2013.01); *A47G 9/04* (2013.01); *A47G 9/10* (2013.01); *A47G 9/1009* (2013.01); *B68G 11/04* (2013.01); *A47C 7/021* (2013.01); *A47C 7/16* (2013.01); *A47C 7/18* (2013.01); *A47C 7/20* (2013.01); *A47C 7/24* (2013.01); *A47G 2009/1018* (2013.01)

(58) Field of Classification Search

CPC ..... A47C 27/16; A47C 27/14; A47C 31/105; A47C 7/021; A47C 7/0213; A47C 7/16; A47C 7/18; A47C 7/185; A47C 7/20; A47C 7/24; A47G 9/0253; A47G 9/04; A47G 9/10; A47G 9/1009; A47G 2009/1018; B68G 11/04; A61H 2201/0142; A61H 2201/0149

USPC ..... D6/601

See application file for complete search history.

(56) References Cited

U.S. PATENT DOCUMENTS 7,353,553 B2 * 4/2008 Huse ..... A47C 27/16 297/452.53

* cited by examiner

*Primary Examiner* — Nicholas F Polito
*Assistant Examiner* — Morgan J McClure

(57) ABSTRACT

A cushion includes a cushion core, adopting blasted sponge, and the cushion core comprising a main bearing area and an auxiliary bearing area; an outer cover layer, wrapping an outer layer of the cushion core, and the outer cover layer adopting a fiber material which is of a reticular structure; and a reinforcing skeleton comprising a plurality of bone bridges, and each bone bridge comprising an arch base and an arch bridge. For each bone bridge, the arch base is located at two side-by-side corners of one side of the cushion core, and is close to one side of the main bearing area; one end of the arch bridge is connected to the arch base, and the other end of the arch bridge extends to a diagonal opposite corner of the other side of the cushion core, and is close to one side of the auxiliary bearing area.

7 Claims, 3 Drawing Sheets

(51) Int. Cl.
*A47C 7/18* (2006.01)
*A47C 7/20* (2006.01)

CUSHION

CROSS-REFERENCE TO RELATED APPLICATION

This application claims priority to Chinese Application No. 201611040756.4 filed on Nov. 21, 2016, the entire contents of which are hereby incorporated by reference.

FIELD OF THE INVENTION

The present invention relates to the field of cushions for daily use, and in particular to a cushion.

BACKGROUND OF THE INVENTION

Cushions are comfortable to use, and have a decorative function, and shapes are mainly square, round and elliptic.

The material is selected from cotton cloth, flannelette, brocade or linen, and the most comfortable material is memory foam material.

At present, cushion cores used in cushions often adopt sponge. However, if the density of the adopted sponge is high, hardness will be increased inevitably, water permeability and air permeability will become poor, and elastic property will be poor. If the density of the adopted sponge is low, hardness will be decreased, air permeability will be improved, nevertheless, heavy weight cannot be borne, the sponge can be compacted easily, increasing the sponge density of the pressed area in another way, as a result, the local density of the sponge of the area in actual use is high, hardness is increased, water permeability and air permeability become poor, elastic property is poor, and the comfort of the sponge in use will be decreased as well.

Moreover, the sponge used by conventional cushions is poor in water permeability and air permeability, and cannot be washed directly with water as it can easily absorb water.

SUMMARY OF THE INVENTION

The present invention provides a cushion, so that the defects of conventional cushions, poor water permeability and air permeability and incapability of being washed directly with water, of conventional cushions are solved.

In order to solve the above-mentioned problems, the present invention discloses a cushion, which comprises: a cushion core adopting blasted sponge, and an outer cover layer wrapping the outer layer of the cushion core; and the outer cover layer adopts a fiber material which is of a reticular structure.

The novel cushion designed by the present invention, which adopts the blasted sponge structure, is convenient to wash directly with water and has super air permeability.

Alternatively, the cushion core comprises a main bearing area and an auxiliary bearing area.

Alternatively, the cushion further comprises a reinforcing skeleton, the reinforcing skeleton comprises a plurality of bone bridges, and each bone bridge comprises an arch base and an arch bridge; the arch bases are located at two side-by-side corners of one side of the cushion core, and are close to one side of the main bearing area; one end of each arch bridge is connected to the arch base, and the other end extends to the diagonal opposite corner of the other side of the cushion core, and is close to one side of the auxiliary bearing area. The main bearing area and the auxiliary bearing area comprised by the arranged cushion core and the reinforcing skeleton are arranged differentially according to magnitudes of different borne forces. Moreover, the structure of the reinforcing skeleton effectively prevents the defect that after conventional sponge is pressed to deform, the local sponge density of the stressed area is increased, as a result, the local density of the sponge of the area in actual use is high, hardness is increased, water permeability and air permeability become poor, elastic property is poor, and the comfort of the sponge in use will be decreased as well.

Alternatively, the number of the bone bridges is two, and the two bone bridges are arranged crisscross intersected; and two hollow elastic pieces which are superposed vertically are arranged under the intersection between the two bone bridges.

As the two bone bridges are arranged crisscross intersected and the two hollow elastic pieces which are superposed vertically are arranged under the intersection between the two bone bridges, the compression resistance of the main bearing area is higher, and elasticity is better.

Alternatively, each hollow elastic piece is a hexagonal hollow elastic plastic piece, and the elastic coefficient of the elastic plastic piece is 1.2 times the elastic coefficient of the blasted sponge. As the elastic coefficient which is 1.2 times is set, comfort is better.

Alternatively, each arch base is provided with a plurality of arch holes. The arrangement of the plurality of arch holes further reduces the weight of the arch base, and enhances compression resistance.

Alternatively, each arch bridge is provided with a plurality of air-permeable slots.

Alternatively, each air-permeable slot is rectangular. The arrangement of the rectangular air-permeable slots effectively improves the air permeability of the local areas of the arch bridges.

Alternatively, the outer cover layer is provided with an opening, and the opening can be opened and closed by a zipper.

Compared with the prior art, the present technical solution has the following advantages:

The novel cushion designed by the present invention, which adopts the blasted sponge structure, is convenient to wash directly with water and has super air permeability.

In addition, the main bearing area and the auxiliary bearing area comprised by the arranged cushion core and the reinforcing skeleton are arranged differentially according to magnitudes of different borne forces. Moreover, the structure of the reinforcing skeleton effectively prevents the defect that after conventional sponge is pressed to deform, the local sponge density of the stressed area is increased, as a result, the local density of the sponge of the area in actual use is high, hardness is increased, water permeability and air permeability become poor, elastic property is poor, and the comfort of the sponge in use will be decreased as well. As the two bone bridges are arranged crisscross intersected and the two hollow elastic pieces which are superposed vertically are arranged under the intersection between the two bone bridges, the compression resistance of the main bearing area is higher, and elasticity is better.

As the elastic coefficient which is 1.2 times is set, comfort is better. The arrangement of the plurality of arch holes further reduces the weight of the arch base, and enhances compression resistance. The arrangement of the rectangular air-permeable slots effectively improves the air permeability of the local areas of the arch bridges.

1. Cushion core; 2. Outer cover layer; 3. Reinforcing skeleton; 4. Main bearing area; 5. Auxiliary bearing area; 6. Opening; 11. Bone bridge; 12. Arch base; 14. Arch bridge; 15. Hollow elastic piece; 21. Arch hole; 22. Air-permeable slot.

DETAILED DESCRIPTION OF THE INVENTION

In reference to the drawings, according to specific embodiments, the technical solution of the present invention is described clearly and completely below.

Embodiment 1

Figure 1:
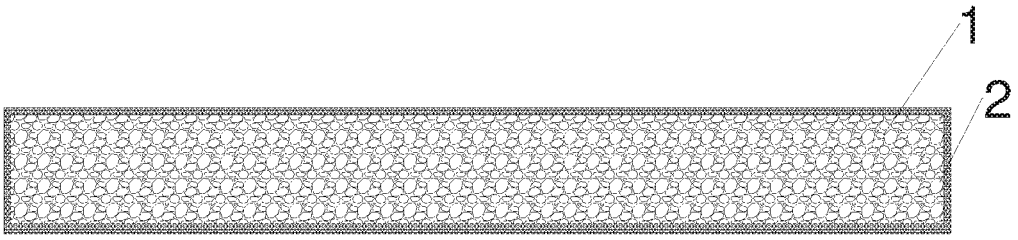
FIG. 1 is a top structural schematic diagram of embodiment 1 of a cushion of the present invention.
Figure 2:
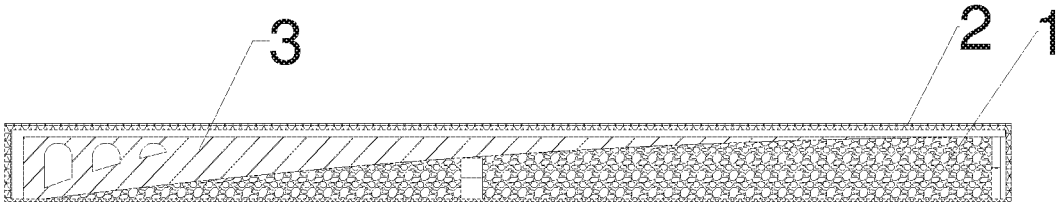
FIG. 2 is a top structural schematic diagram of embodiment 2 of the cushion of the present invention.
Figure 3:
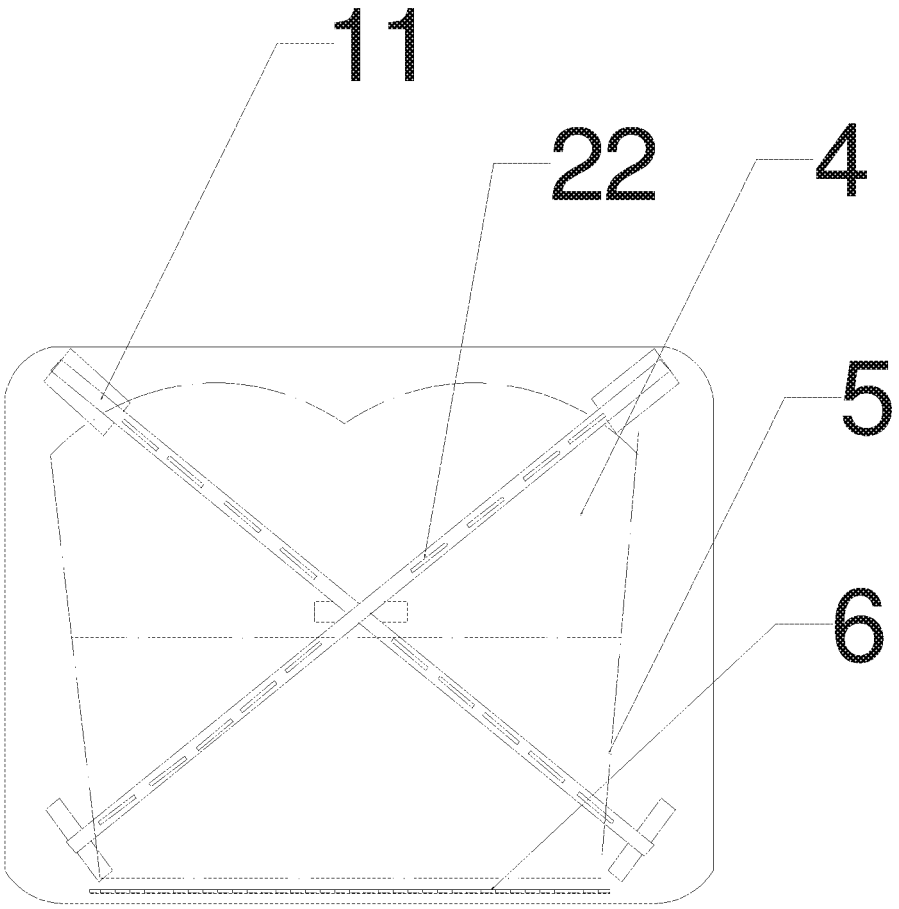
FIG. 3 is a structural schematic diagram of embodiment 2 of the cushion of the present invention along the sections of bone bridges.
Figure 4:
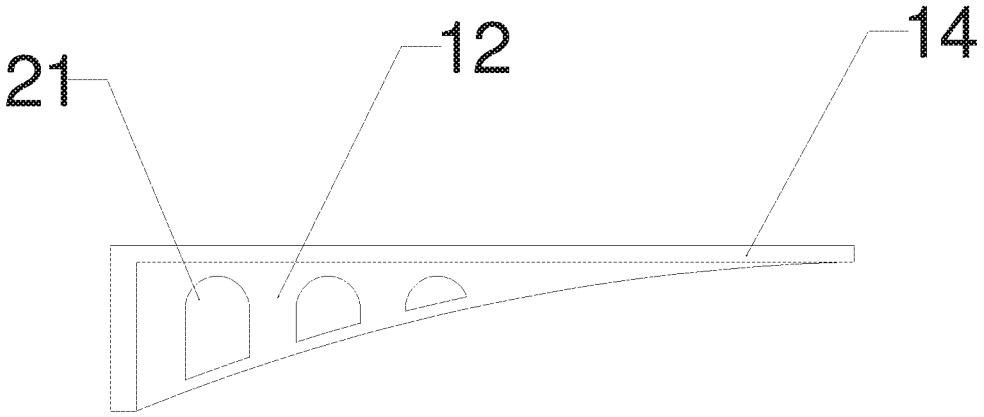
FIG. 4 is a structural schematic diagram of the bone bridge of embodiment 2 of the cushion of the present invention.
Figure 5:
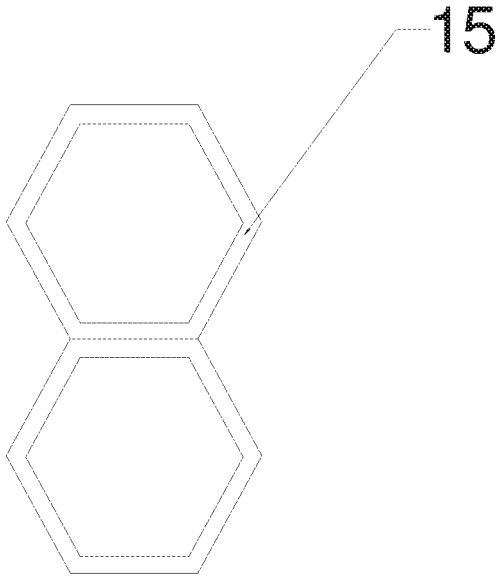
FIG. 5 is a structural schematic diagram of hollow elastic pieces of embodiment 2 of the cushion of the present invention.

The present invention discloses a cushion (see FIG. 1), which comprises: a cushion core 1 adopting blasted sponge, and an outer cover layer 2 wrapping the outer layer of the cushion core 1; and the outer cover layer 2 adopts a fiber material which is of a reticular structure. The novel cushion designed by the present invention, which adopts the blasted sponge structure, is convenient to wash directly with water and has super air permeability.ppi mentioned in the present invention is hole number per unit inch. The hardness of the blasted sponge in the present invention is 60 N to 80 N. The outer cover layer is provided with an opening 6, and the opening 6 can be opened and closed by a zipper. The cushion of the present invention is applicable to specific household products, such as seat cushions, pillows, waistrests, mattresses and headrests.

Embodiment 2

The present invention discloses a cushion (see FIGS. 2, 3, 4, 5), which comprises: a cushion core 1 adopting blasted sponge, and an outer cover layer 2 wrapping the outer layer of the cushion core 1; and the outer cover layer 2 adopts a fiber material which is of a reticular structure. The novel cushion designed by the present invention, which adopts the blasted sponge structure, is convenient to wash directly with water and has super air permeability.

The cushion core 1 comprises a main bearing area 4 and an auxiliary bearing area 5. The cushion further comprises a reinforcing skeleton 3, the reinforcing skeleton 3 comprises a plurality of bone bridges 11, and each bone bridge 11 comprises an arch base 12 and an arch bridge 14; the arch bases 12 are located at two side-by-side corners of one side of the cushion core 1, and are close to one side of the main bearing area 4; one end of each arch bridge 14 is connected to the arch base 12, and the other end extends to the diagonal opposite corner of the other side of the cushion core 1, and is close to one side of the auxiliary bearing area 5. The main bearing area 4 and the auxiliary bearing area 5 comprised by the arranged cushion core 1 and the reinforcing skeleton 3 are arranged differentially according to magnitudes of different borne forces. Moreover, the structure of the reinforcing skeleton 3 effectively prevents the defect that after conventional sponge is pressed to deform, the local sponge density of the stressed area is increased, as a result, the local density of the sponge of the area in actual use is high, hardness is increased, water permeability and air permeability become poor, elastic property is poor, and the comfort of the sponge in use will be decreased as well.

The number of the bone bridges 11 is two, and the two bone bridges 11 are arranged crisscross intersected; and two hollow elastic pieces 15 which are superposed vertically are arranged under the intersection between the two bone bridges 11. As the two bone bridges 11 are arranged crisscross and the two hollow elastic pieces 15 which are superposed vertically are arranged under the intersection between the two bone bridges 11, the compression resistance of the main bearing area 4 is higher, and elasticity is better.

Each hollow elastic piece 15 is a hexagonal hollow elastic plastic piece, and the elastic coefficient of the elastic plastic piece is 1.2 times the elastic coefficient of the blasted sponge. As the elastic coefficient which is 1.2 times is set, comfort is better.

Each arch base 12 is provided with a plurality of arch holes 21. The arrangement of the plurality of arch holes 21 further reduces the weight of the arch base 12, and enhances compression resistance. Each arch bridge 14 is provided with a plurality of air-permeable slots 22. Each air-permeable slot 22 is rectangular. The arrangement of the rectangular air-permeable slots 22 effectively improves the air permeability of the local areas of the arch bridges 14. The outer cover layer is provided with an opening 6, and the opening 6 can be opened and closed by a zipper.

When the present embodiment is implemented, the zipper can be opened to take out or install the cushion core, and thereby replacement can be carried out; during use, the arch bridges are upward, the arch bridge surfaces are fronts, the hips or the back of the head of a user press the main bearing area, and the legs or the neck press the auxiliary bearing area.

Although the present invention has been disclosed above with the preferred embodiments, the preferred embodiments are not intended to limit the present invention. Any person killed in the art can utilize the method and technical content disclosed above to make possible alterations and modifications on the technical solution of the present invention without departing from the spirit and scope of the present invention, so any content not departing from the technical solution of the present invention, any simple modifications, equivalent changes and embellishments made on the above-mentioned embodiments according to the technical essence of the present invention, shall fall within the protection scope of the technical solution of the present invention.

The invention claimed is:

1. A cushion comprising:

a cushion core, adopting blasted sponge, and the cushion core comprising a main bearing area and an auxiliary bearing area;

an outer cover layer, wrapping an outer layer of the cushion core, and the outer cover layer adopting a fiber material which is of a reticular structure; and a reinforcing skeleton comprising a plurality of bone bridges, and each bone bridge comprising an arch base and an arch bridge;

wherein, for each bone bridge, the arch base is located at two side-by-side corners of one side of the cushion core, and is close to one side of the main bearing area; one end of the arch bridge is connected to the arch base, and an other end of the arch bridge extends to a diagonal opposite corner of an other side of the cushion core, and is close to one side of the auxiliary bearing area.

2. The cushion according to claim 1, wherein the plurality of bone bridges comprise two bone bridges, and the two bone bridges are arranged crisscross intersected; and two hollow elastic pieces which are superposed vertically are arranged under the intersection between the two bone bridges.

3. The cushion according to claim 2, wherein each hollow elastic piece is a hexagonal hollow elastic plastic piece, and an elastic coefficient of the elastic plastic piece is 1.2 times an elastic coefficient of the blasted sponge.

4. The cushion according to claim 1, wherein each arch base is provided with a plurality of arch holes.

5. The cushion according to claim 1, wherein each arch bridge is provided with a plurality of air-permeable slots.

6. The cushion according to claim 5, wherein each air-permeable slot is rectangular.

7. The cushion according to claim 1, wherein the outer cover layer is provided with an opening, and the opening can be opened and closed by a zipper.

* * * * *